US005535606A

United States Patent [19]

Nguyen et al.

[11] Patent Number: 5,535,606

[45] Date of Patent: * Jul. 16, 1996

[54] COMPACT POWER DETACHER

[75] Inventors: Thang T. Nguyen, Boca Raton; Frank Drucker, Plantation, both of Fla.

[73] Assignee: Sensormatic Electronics Corporation, Deerfield Beach, Fla.

[ * ] Notice: The term of this patent shall not extend beyond the expiration date of Pat. No. 5,426,419.

[21] Appl. No.: 313,321

[22] Filed: Sep. 27, 1994

[51] Int. Cl.[6] ..... E05B 65/00

[52] U.S. Cl. ..... 70/57.1; 340/572; 307/139

[58] Field of Search ..... 70/57.1, 267, 268, 70/271, 272, 273, 434, 280; 307/139, 141, 141.4; 340/572; 24/704.1

[56] References Cited

U.S. PATENT DOCUMENTS

| | | | |
|---|---|---|---|
| 3,858,280 | 1/1975 | Martens | 24/704.1 |
| 3,914,829 | 10/1975 | Paskert . | |
| 3,947,930 | 4/1976 | Martens et al. | 24/704.1 |
| 4,196,424 | 4/1980 | Williamson | 70/57.1 |
| 4,287,395 | 9/1981 | Martin | 307/141 |
| 4,311,992 | 1/1982 | De Chant | 340/572 |
| 4,406,953 | 9/1983 | Tanaka et al. | 307/141 |
| 4,426,639 | 1/1984 | Jessup | 307/141 |
| 4,745,664 | 5/1988 | Damvig | 24/704.1 |
| 4,987,754 | 1/1991 | Minasy et al. | 70/57.1 |
| 5,357,143 | 10/1994 | Lehr et al. | 307/10.1 |
| 5,426,419 | 1/1995 | Nguyen et al. | 70/57.1 X |

FOREIGN PATENT DOCUMENTS

| | | | |
|---|---|---|---|
| 0385540 | 9/1990 | European Pat. Off. | 70/57.1 |

*Primary Examiner*—Steven N. Meyers
*Assistant Examiner*—Suzanne L. Dino
*Attorney, Agent, or Firm*—Robin, Blecker, Daley & Driscoll

[57] ABSTRACT

Apparatus for detaching an electronic surveillance tag from an article to which it is attached, the tag having a locking member therein and defining an exteriorly accessible passage to the locking member, comprises a motor, a probe rotatable by the motor for movement in the passage into and from unlocking relation with the locking member and drive controller for the motor. The drive controller includes circuitry for (1) establishing a time period for energization of the motor, (2) effecting first sense movement of the probe during a first portion of the time period, (3) discontinuing movement of the probe during a second portion of the time period, and (4) effecting second sense movement of the probe following expiration of the second portion during a third portion of the time period.

23 Claims, 15 Drawing Sheets

COMPACT POWER DETACHER

FIELD OF THE INVENTION

This invention relates generally to security tags and associated detachers and, more particularly, to a security tag detacher for use in an electronic article surveillance (EAS) system.

BACKGROUND OF THE INVENTION

Electronic article surveillance systems are well known in the art and are used for inventory control and to prevent theft and similar unauthorized removal of articles from a controlled area. Typically, in such systems a system transmitter and a system receiver are used to establish a surveillance zone which must be traversed by any articles being removed from the controlled area.

An EAS tag is affixed to each article and includes a marker or sensor adapted to interact with a signal being transmitted by the system transmitter into the surveillance zone. This interaction causes a further signal to be established in the surveillance zone which further signal is received by the system receiver. Accordingly, upon movement of a tagged article through the surveillance zone, a signal will be received by the system receiver, identifying the unauthorized presence of the tagged article in the zone.

Certain types of EAS tags have been designed to be reusable and, thus, include releasable attachment devices for affixing the tags to the articles. Such attachment devices are further designed to be releasable by authorized personnel only so that unauthorized removal of a tag from its article is avoided. To this end, many attachment devices are made releasable only through the use of an associated special tool or detaching mechanism.

An EAS tag employing an attachment device and an associated detacher is described in U.S. Pat. No. 3,942,829, entitled REUSABLE SECURITY TAG, issued to Humble, et al. on Mar. 9, 1976 and assigned to the assignee hereof. The EAS tag of the '829 patent includes a tag body and an attachment device in the form of a tack assembly. The tack assembly includes an enlarged head and a tack body having a pointed end which serves to pierce through an article and to be receivable in and clamped to the tag body. This secures the article and tag together.

In the tag of the '829 patent, the tack is clamped to the tag body using a spring clamp formed as a clutch lock with spreadable jaws. Once the article is pierced, the pointed tack end is received in the tag body and is secured between the jaws of the clutch lock. This locks the tack and the tag body forming the EAS tag to the article so that the tag and article cannot be readily separated from each other.

In order for authorized personnel to be able to release the tack from the clutch lock and, therefore, the tag from the article, the '829 patent utilizes a detacher mechanism which is adapted to grip the tag body and apply a bending force thereto. This force is sufficient to deform the clutch lock so that the jaws of the clutch lock are spread apart, thereby releasing the tack. The tack can then be removed from the tag body so that the article and tag become separated from one another.

To permit the bending of the tag body sufficiently to deform the clutch lock, the tag body of the '829 patent must be made of a flexible material. Typically, flexible plastic materials such as, for example, polypropylene, have been used. Such materials, however, are susceptible to being cut and damaged. This tends to be a disadvantage, since it increases the likelihood that the locking feature of the tag can be separated from the EAS sensor part of the tag or can be exposed and defeated.

Moreover, the tag body of the '829 patent must be relatively large in size in order to facilitate its flexing. This likewise tends to be a disadvantage, since use of large tags detracts from the aesthetic appearance of the articles to which the tags are attached.

Another type of EAS security device is known in which a variation of the spring clamp of the '829 patent has been incorporated into a so-called keeper for a compact disc. This type of device is disclosed in U.S. Pat. No. 5,031,756, entitled KEEPER FOR COMPACT DISC PACKAGE OR THE LIKE, issued to Buzzard, et al. on Jul. 16, 1991 and also assigned to the assignee hereof. The keeper of the '756 patent comprises a rigid plastic frame. One side of the frame is provided with an enlarged section which houses a tack-like button assembly and a spring clamp as in the '829 patent. In this case, the spring clamp is used to lock the button assembly in a first position. In this position, the pointed end of the button assembly protrudes into the frame to pierce and hold to the frame a cardboard container containing a compact disc. As a result, unauthorized removal of the compact disc with the frame causes an EAS sensor also incorporated into the frame, to generate a detectable signal for alarming an EAS system.

In the keeper of the '756 patent, the enlarged section of the frame is provided with opposing linear slots which lead to the region between the jaws of the spring clamp. By inserting ramped linear fingers into these slots, the fingers are guided into this region, causing the jaws to flex outward. This releases the button enabling it to be withdrawn from the cardboard container. The container and its housed compact disc can then be separated from the frame.

While the keeper of the '756 patent utilizes a spring clamp of the '829 patent type in a rigid frame, it also has certain drawbacks. One drawback is that the linear slots leading to the spring clamp permit in-line viewing and access to the clamp. This increases the susceptibility of the clamp to defeat, since linear objects can be inserted into the slots in an attempt to open the jaws. Another drawback is that the fingers of the detacher are required to be of high precision, since they must be received in the region between the spring clamp jaws. This increases the cost and complexity of the detacher.

A related, commonly-assigned, pending patent application, namely, Ser. No. 08/004,592, filed on Jan. 14, 1993 and entitled SECURITY TAG HAVING ARCUATE CHANNEL AND DETACHER APPARATUS FOR SAME, provides an EAS tag and a detacher which do not suffer from the above disadvantages.

To the extent that the subject invention is directed to an improved detacher for such security tag having an arcuate channel, and that the '592 patent application is not incorporatable herein by reference, the application is now largely set forth.

FIGS. 1–7 show various views of an EAS tag 1 in accordance with the '592 patent application. As shown (see, FIG. 1), the tag 1 includes an upper housing 2 having side walls 2A, 2B, 2C and 2D which are joined by a top wall 2E. The tag 1 also includes a lower housing 3 having side walls 3A, 3B, 3C and 3D which are joined by a bottom wall 3E. The upper and lower housings 2 and 3 are joined or mated along corresponding or associated side wall pairs (2A, 3A), (2B, 3B), (2C, 3C) and (2D, 3D) to form a closed tag body 1A.

The housings 2 and 3 are preferably made of a hard or rigid material. A usable rigid or hard material might be a hard plastic such as, for example, an injection molded ABS plastic. If a plastic is used, the mating side walls of the housings can be joined by an ultrasonic weld 1B or like joining mechanism.

The tag 1 further includes a tack assembly 4 shown as having an enlarged tack head 4A and an elongated tack body 4B provided with slots or grooves 4C and a pointed forward end 4D (see, FIGS. 1, 2 and 6A). The tack assembly 4 is used to attach the tag body 1A to an article 51 which is to be protected by the EAS tag 1.

In order to sense the tag 1 and, therefore, detect the presence of the tag and the attached article 51, the inner surfaces 2F and 3F of the walls 2E and 3E of the housings 2 and 3 are provided with frame members 2G and 3G which together define an interior cavity 1C for receiving an EAS sensor 5 (see, FIGS. 2, 3 and 4A). The EAS sensor 5 generates detectable signals and can be an acoustically resonant magnetic sensor as disclosed in U.S. Pat. Nos. 4,510,489 and 4,510,490. Possible other magnetic EAS sensors usable for the sensor 5 might be those disclosed in U.S. Pat. Nos. 4,686,516 and 4,797,658 and possible RF EAS sensors might be those disclosed in U.S. Pat. Nos. 4,429,302 and 4,356,477. The teachings of these patents are incorporated herein by reference.

As above-noted, the article 51 is joined to the tag body 1A by the tack assembly 4. This is accomplished by inserting the tack body 4B into an opening 2H in the wall 2E of the upper housing 2. When the tack body 4B is fully inserted, the pointed end 4D of the tack is received in an upstanding cavity or collar 3H extending from the inner surface 3F of the lower housing wall 3E. The tack head 4A, in turn, seats in a recessed area 2I in the upper surface 2J of the wall 2E. The article 51 is thus held between the tack head 4A and the latter wall.

Means 6 to be discussed in greater detail below is provided within the tag body 1A for releasably preventing the tack body 4B from being withdrawn from the tag body. The tack assembly 4 and the article 51 thus become releasably locked to the EAS tag 1 by the means 6.

In accordance with the principles of the '592 patent application, the EAS tag 1 is further adapted so that access to the means 6 for releasing same is made difficult for other than authorized personnel. To this end, the tag body 1A is configured so that access to the means 6 is through an arcuate channel 7 (see FIGS. 1, 3, 4A, 4B, 6A and 6B) defined by one or more inner walls and by parts of the side walls and upper and lower walls of the tag body 1A. With this configuration, a special arcuate probe 8 is needed to reach and release the means 6 and, thus, detach the tack assembly 4 and the article from the tag body 1A.

As shown, the arcuate channel 7 is defined by a curved inner wall 7A. This wall extends upward from the inner surface 3F of the bottom housing 3 to abut the inner surface 2F of the upper housing 2. The wall 7A is further spaced from the side wall 3D of the bottom housing 3 and its outward end 7A' terminates at an inward curved part 3A' of the side wall 3A. The inward curved part 3A' of the wall 3A results in a space or slot 9A between the side walls 3A and 3D of the lower housing 3.

The slot 9A cooperates with a similar slot 9B between the sides wall 2A and 2D of the upper housing 2 to define a second opening 9 for providing entry or access into the outward end 7' of the channel 7. At this entry point, the side wall 2A also curves inwardly at a part 2A', the latter part 2A' mating with the curved side wall part 3A' of the side wall 3 of the lower housing 3.

The channel 7 is further defined by a second curved wall 7B (see, FIGS. 4A and 7) extending downwardly from the inner surface 2F of the upper housing 2. The wall 7B is situated outward of the inner end 7A" of the curved wall 7A and extends beyond this end to the frame member 2G.

The presence of the wall 7B changes or alters the configuration of the channel 7 at its inner end 7" which end lies adjacent the means 6 (see, FIG. 6B). This change or alteration in configuration defines a keyway for the channel 7 which must be accommodated by the probe 8 to pass through the channel and gain access to the means 6.

In the case illustrated, the wall 7B changes the channel cross section from substantially rectangular to substantially L-shaped. This is illustrated in the cross section of FIG. 7 which has been taken along the line B—B in FIG. 1 so that the cross section of the channel end 7" is made visible.

FIGS. 6A and 6B are enlarged views of the section of the lower housing 3 containing the means 6 and the arcuate channel 7. In FIG. 6A, the arcuate probe 8 is shown as received in and guided by the channel 7 to the means 6 for the purpose of releasing same. As can be seen, the forward end 8A of the probe 8 is recessed so as to be L-shaped and, thus, fit within the L-shaped keyway defined by inner end 7" of the channel. In FIG. 6B, the probe 8 is shown as withdrawn from the channel.

Adjacent the inner end 7" of the channel 7, the lower and upper housings 2 and 3 are provided with further curved walls 9 and 11 which terminate in wall sections 9A and 11A abutting the end walls 2D and 3D. The walls 9 and 11 are outward of the channel 7 and, with the end walls 2D and 3D, define a trap area 13 which prevents access to the means 6. This area provides a safety measure for blocking unauthorized objects introduced into the channel 7 of the tag body 1A in an attempt reach the means 6.

As above-noted, the means 6 is adapted to releasably prevent the tack body 4B from being withdrawn from the tag body 1A. More particularly, in further accord with the '592 patent application, the means 6 is specifically adapted to accommodate release of the tack body 4B via the arcuate probe 8 moving in the arcuate channel 7. The means 6 is shown in detail in FIGS. 6A and 6B and in an exploded view in FIG. 5.

As shown, the means 6 is in the form of a spring clamp having a clamp body 14 and jaws 15 and 16. The clamp body includes a mounting part 14A extending laterally of the jaw 15 and a release part 14B extending laterally of the jaw 16. The mounting part 14A includes a mounting aperture 14A'.

Each of the jaws 15, 16 extends outwardly of the plane of the clamp body 14 and then inwardly toward the other jaw. The jaws 15, 16, furthermore, terminate in facing edges 15A and 16A. These edges extend from a common edge 14C of the clamp body 14 inwardly toward each other, then curve outwardly away from each other to define an aperture 14C' (typically, circular or elliptical) for receiving the tack body 4B. The edges 15A and 16A then continue in aligned fashion and end in an elongated, lateral slot 14D in the clamp body 14. The latter slot lies inward of a further clamp body edge 14E which opposes the clamp body edge 14C.

A further laterally extending elongated spring sleeve or arm 17 is attached by a joint area 18 to the side 14E' of the edge 14E bordering the mounting part 14A. The sleeve 17 extends along the length of the edge 14E and is also out of the plane of the clamp body.

For mounting and supporting the spring clamp 14, the lower housing 3 of the tag body 1A includes a hollow circular mount 21 with a lip 21A and support walls 22, 23 and 24 (see, FIGS. 2, 3, 6A and 6B). The clamp is mounted, via the aperture 14A' of the mounting part 14, on the mount 21 with the area of mounting part adjoining the aperture 14A' supported on the lip 21A. A circular wall 25 of the upper housing 3 and a central cylindrical stud 26 of this housing (see, FIGS. 2 and 4A) maintain the mounting part 14A in its mounted position, while allowing the mounting part to be rotated. The spring clamp 14 is thus able to pivot about the mounting part as will be described more fully below.

The back end 14A" of the mounting part 14A and the lateral part of the clamp connecting the mounting part 14A and the release part 14B are supported on the support walls 22 and 24, while the release part is carried by the wall 23. The spring sleeve 17 rests with one end 17A in a slot 24A in the support wall 24.

When the pointed end 4D of the tack body 4B is introduced in the downward direction through the opening 2H in the upper housing 2, the part 2K of the upper housing, which part is shaped to fit within the hollow of the spring clamp body 14 above the jaws 15, 16 and carries the opening 2H, directs the tack body to the aperture 14C' defined by the facing edges 15A, 16A of the jaws. This causes the jaws to spread or open and allow the tack body 4B to pass through the jaws.

When the downward tack travel is stopped at a desired slot 4C, i.e., a slot which provides a tight fit of the tack head 4A and article 51 to the wall 2E of upper housing 2, the jaws 15, 16 retract and clutch the tack body 4B. In this position, the jaws 15, 16 prevent upward movement of the tack 4. The tack 4 and article 51 thus become locked to the tag body 1A.

In order to release the tack 4 from the tag body 1A, the arcuate probe 8 is now introduced into the opening of the tag body 1A via rotation of the probe about its rearward end 8B. This causes the probe to be moved in and guided by the channel 7 until the L-shaped forward end 8A of the probe reaches and passes into the L-shaped inner end 7" of the channel 7. This brings the probe end 8A to the part of the common edge 14C bordering the release part 14B of the clamp body 14.

Continued rotational movement of the probe 8 then causes a torsional force F to be exerted in the plane of the clamp body 14 on the release part 14B. This force, in turn, causes the clamp body 14 to rotate about the support area 14A on the mount 21. The jaws 15, 16 are thus enabled to spread apart or open due to the force of the tack body 4B, which is held stationary by the collar 3H, acting on the walls of the aperture 14C'. The aperture 14C' thus expands, releasing the tack body 4B from the grip or clutch of the jaws. The tack 4 can now be moved in the upward direction past the jaws, via an upward force on the tack head 4A, thereby withdrawing and separating the tack body 4B from the tag body 1A and the article 51 from the tag 1.

During rotation of the spring clamp body 14 as a result of the in-plane force exerted by the probe 8, the spring arm 17 at the joint 18 is compressed. After the tack 1 is separated from the tag body 1A, the probe 8 is rotated in the reverse direction. This reverse rotation disengages the probe from the release part 14A of the spring clamp 14 as the probe 8 is withdrawn from the channel 7. The force on the spring clamp 14 is thus removed and the spring arm 17 expands. This causes the spring clamp 14 to rotate in the opposite direction about the support area 14A. The spring clamp 14 is thereby brought back to its original position awaiting reentry of the tack body 4B for again attaching an article to the tag 1.

FIGS. 8–10 show an embodiment of a detaching assembly which incorporates the arcuate detaching probe 8. The assembly can be used to rotate the probe as above-described to detach the tack 4 from the tag 1.

The detaching assembly 81 of FIGS. 8–10 is a power actuated/tag activated assembly and includes a detaching mechanism 82 (see, FIG. 10) which is covered by a removable detacher cover 83. As shown in FIGS. 8 and 9, the detacher cover 83 includes a nesting or cradle area 84 for receiving the tag body 1A of the tag 1. The cover 83 also includes an ON/OFF switch aperture 85 sized to accommodate an ON/OFF switch 91 of the detaching mechanism 82. A further aperture 86 of the cover 83 receives a light emitting diode (LED) 92 which indicates the on/off status of the detaching mechanism.

As shown in FIG. 10, the detaching mechanism 82 includes a frame or bottom plate 93 to which is affixed a motor cover 94 having in its upper surface 94B an opening 95. The motor cover 94 houses a motor 94A supported on the plate 93. The motor 94A drives an upstanding shaft 96 which projects out of the opening 95 and is rotatable in either a clockwise or counterclockwise direction as desired (indicated by arrows 97).

A rotatable member 98 has a base 98A which is fixedly attached to an upstanding section 98B. The base 98A is coupled to the shaft 96 and it and the upstanding section 98B rotate with the rotation of the shaft. The upstanding section 98B carries the rearward end 8B of the arcuate probe 8 and rotation of the section 98B causes rotation of the probe 8, as above-described. In order to effect automatic rotation of the probe 8 from an initial position (shown in FIG. 10) to a detachment position (shown in FIG. 6A) and then back to its initial position, the detaching mechanism 82 is additionally provided with first and second activator switches 99 and 101, a reverse switch 102 and a home switch 103. These switches provide signals over lines (not shown) to control electronics 104 mounted on a PC board 105 attached to the base 93. The control electronics 104, in turn, provide drive signals to the motor 94A for driving same to realize movement of the probe arm 8, as above-described.

As shown, the activator switch 99 is mounted on the upper surface 94B of the of the motor cover 94 and includes a body 99A which supports a platform element 106. A spring biased upstanding plunger 99B of the switch 99 extends from the body 98A through the platform element 106 and movement of the plunger 99B downward causes activation of the switch 99. The second activator switch 101 is also mounted to the motor cover 94, but at the forward end of the platform element 106. The switch 101 includes an outwardly extending reed element 101A which when engaged causes activation of the switch.

When the tag 1 is properly mounted in the cradle area 84 of the cover 83, both the plunger 99B of the switch 99 and the reed element 101A of the switch 101 become engaged. This results in simultaneous activation of both the switches 99 and 101, causing simultaneous activation signals to be present at the control electronics 104. The control electronics recognizes this activated condition as signifying that a tag 1 is properly situated in the detacher assembly. It thereupon signals the motor to counterclockwise rotate to move the probe 8 counterclockwise from its initial position into the tag body.

The reverse switch 102 is affixed to the motor cover 94 and has a reed element 102A extending toward the base 98A and positioned to be engaged by the base when the counterclockwise moving probe 8 reaches its detachment position, i.e., its position as shown in FIG. 6A. Activation of the reverse switch by engagement of the reed element 102A causes a further signal to be received by the control electronics 104, indicating that the probe 8 has effected detachment and that the motor rotation should be reversed to withdraw the probe from the tag body. The motor drive signal is changed accordingly and the motor reversed. This causes the base 98A and section 98B to be clockwise rotated, likewise clockwise rotating the probe 8 bringing it out of the tag and back to its initial or starting position.

The home switch 103 is affixed to the motor cover 94 adjacent the upstanding section 98B. As the base 98A and upstanding section 98B are clockwise rotated, a reed element (not shown) on the switch 103 is engaged by the base 98A as the probe 8 returns to its initial position. This results in the home switch 103 signaling the control electronics 104 that the probe 8 has reached this position. The control electronics 104 then adjusts the drive signals to the motor so that the motor rotation stops and the probe 8 is brought to rest at the initial position.

It should be noted that the spring clamp 14 of the tag 1 can be constructed of spring sheet metal. The probe 8, in turn, can be constructed of hardened tool steel.

While the tag and tag detacher of the '592 patent application have proven effective in overcoming the problems of the prior art, certain problems still remain unaddressed. In a first instance, the tag detacher is relatively large in size, occupying more countertop space than is available in certain EAS system markets, particularly in Europe. Some European markets simply do not have physical space to permit installation of the currently-available tag detachers, including that of the '592 patent application.

In a second instance, tagged, quite bulky items, for example, suitcases, are in conflict with the immobility of the known tag detachers, including that of the '592 patent application, in part due to the relatively heavy weight thereof.

SUMMARY OF THE INVENTION

The present invention has as its primary object the provision of improved tag detachers for EAS systems.

In particular, the invention looks to providing tag detachers realizing the functions of the tag detacher of the '592 patent application, however, with lessened weight and enhanced portability.

A further specific object of the invention is to simplify the tag detacher of the '592 patent application.

In attaining the foregoing and other objects, the invention provides apparatus for detaching an electronic surveillance tag from an article to which it is attached, the tag having a locking member therein and defining an exteriorly accessible passage to the locking member, the apparatus comprising a motor, a probe rotatable by the motor for movement in the passage into and from unlocking relation with the locking member and a drive controller for the motor. The drive controller includes circuitry for (1) establishing a time period for energization of the motor, (2) effecting first sense movement of the probe during a first portion of the time period, (3) discontinuing movement of the probe during a second portion of the time period, and (4) effecting second sense movement of the probe following expiration of the second portion during a third portion of the time period.

In another aspect, the invention provides apparatus comprising a motor, a probe rotatable by the motor for movement in the passage into and from a home position to an operative position for unlocking the locking member, a base supporting the motor and the probe and a cover secured to the base and enclosing the motor and the probe, the base and the cover jointly defining structure for releasably securing the apparatus to support structure for the apparatus.

In a further aspect, the invention provides apparatus comprising a motor, a probe rotatable by the motor for movement in the passage into and from a home position to an operative, tag-unlocking position, a base supporting the motor and the probe and stop members fixedly secured to the base at the home position and at the operative position for precluding movement of the probe therebeyond.

The foregoing and other objects and features of the invention will be further understood from the following detailed description of preferred embodiments thereof and from the drawings, wherein like reference numerals identify like components throughout.

DESCRIPTION OF THE DRAWINGS

FIGS. 1 through 10 correspond to like-numbered figures of the '592 patent application.

FIG. 1 shows an EAS tag and associated detacher probe.

FIG. 2 shows a cross-section of the EAS tag of FIG. 1 taken along the line A—A in FIG. 1.

FIG. 3 shows a view of the interior of the lower housing of the EAS tag of FIG. 1.

FIG. 5 illustrates an exploded view of the spring clamp used in the EAS tag of FIG. 1.

FIG. 7 is a cross section of the EAS tag of FIG. 1 taken along the line B—B in FIG. 1 with the probe inserted in the arcuate channel in the tag.

FIG. 8 shows a power actuated/tag activated detacher assembly for detaching the EAS tag of FIG. 1 from an article.

FIG. 9 shows the outer cover of the detacher assembly of FIG. 8.

FIG. 10 shows the detaching mechanism of the detacher assembly of FIG. 8.

DETAILED DESCRIPTION OF PREFERRED EMBODIMENTS AND PRACTICES

Figure 1:
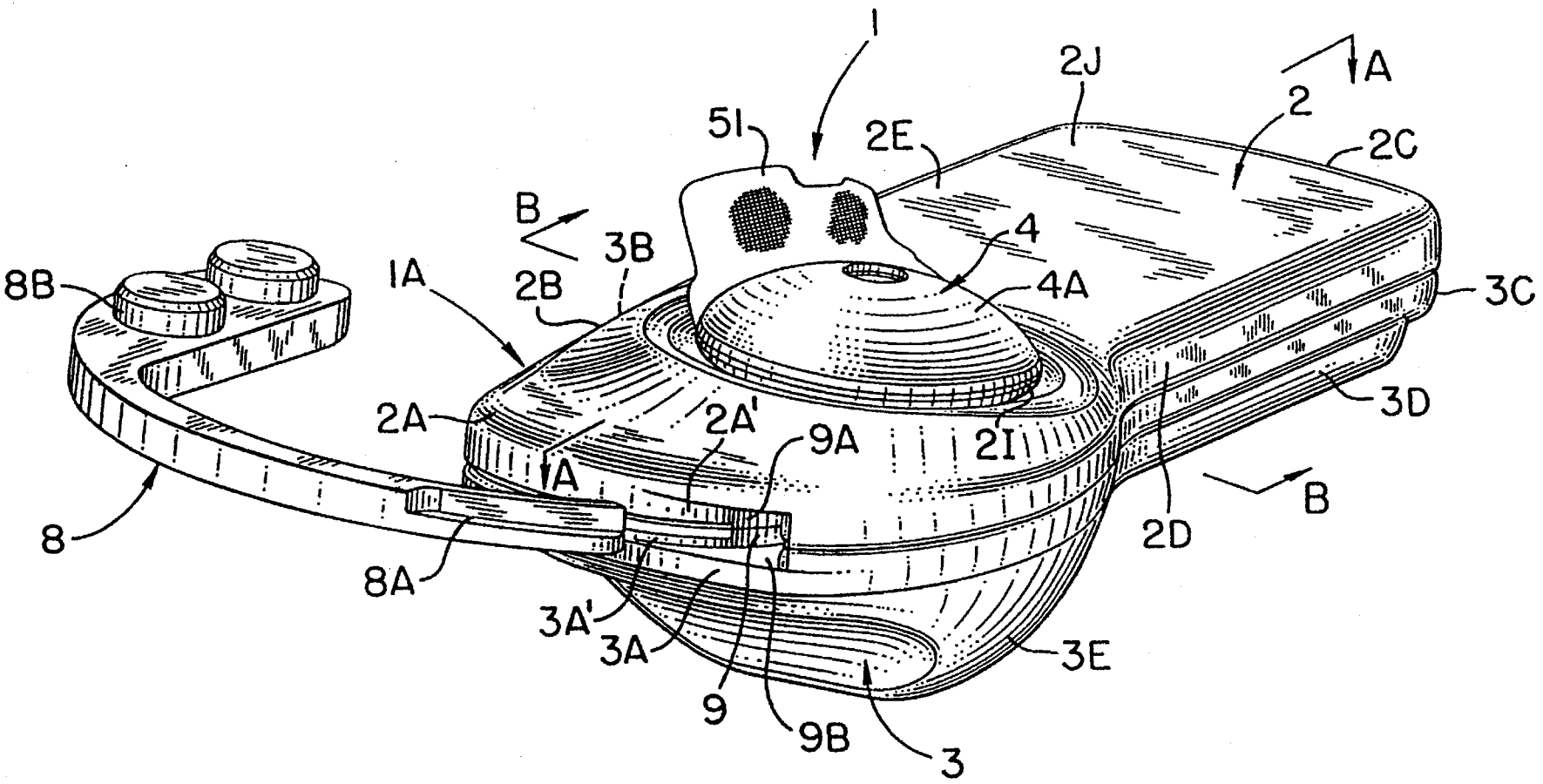
Figure 2:
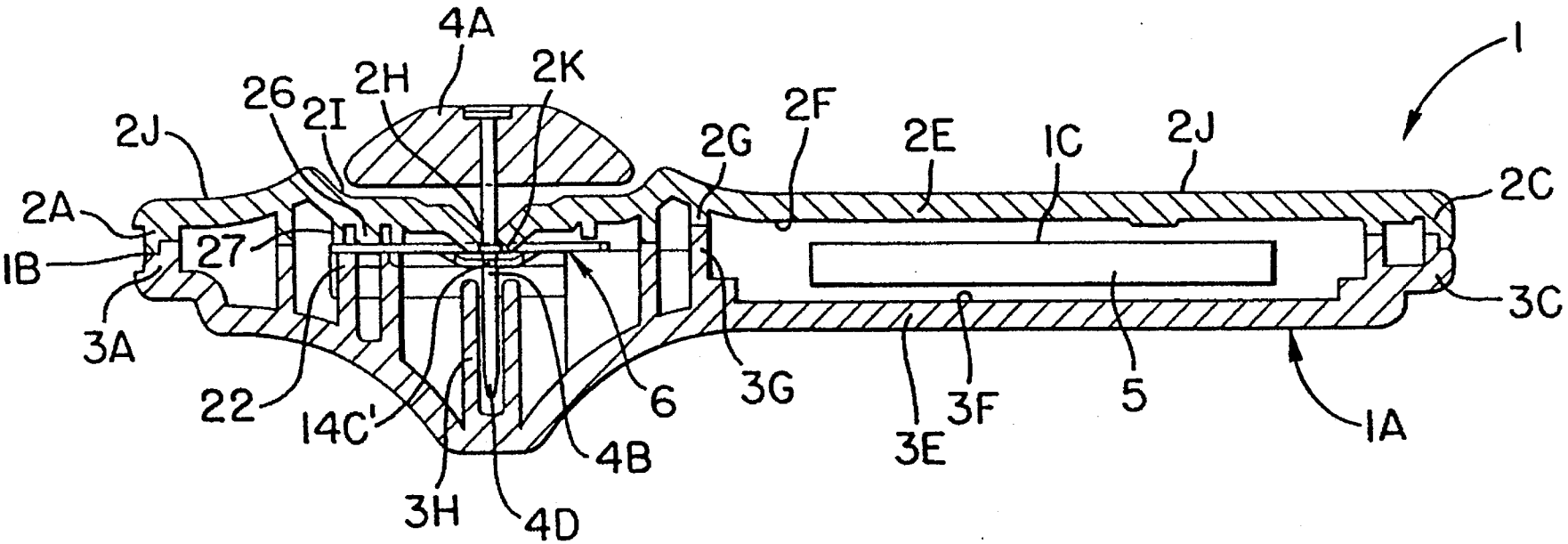
Figure 3:
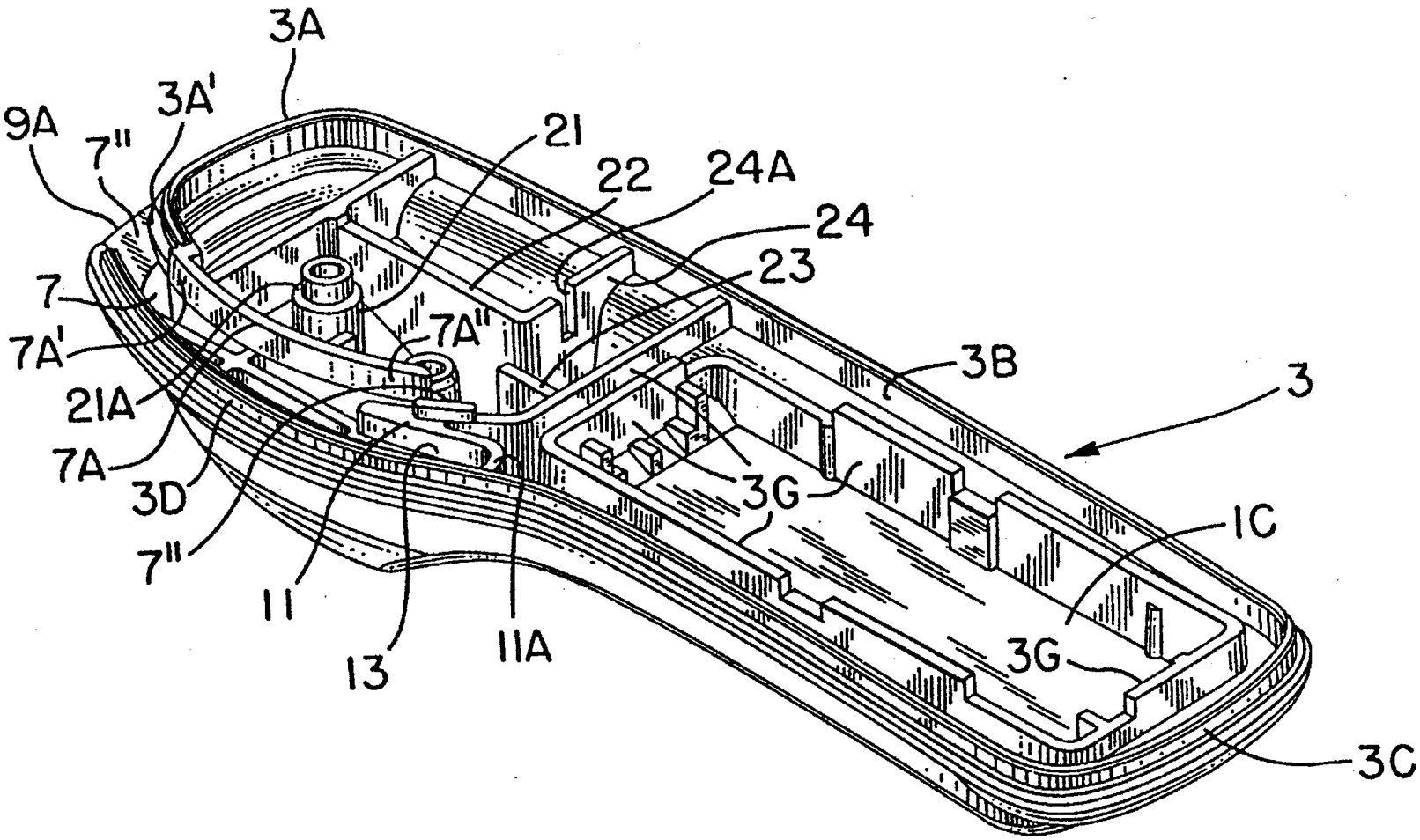
Figure 4B:
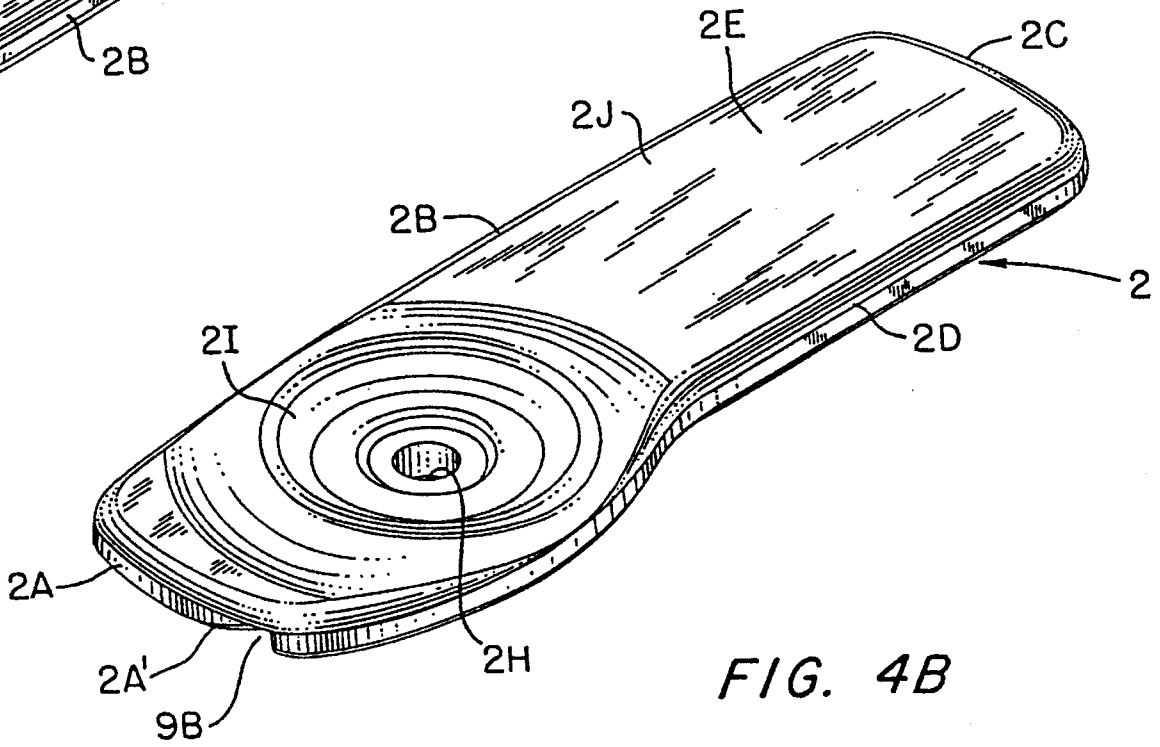
FIG. 4B shows a view of the exterior of the upper housing of the EAS tag of FIG. 1.
Figure 4A:
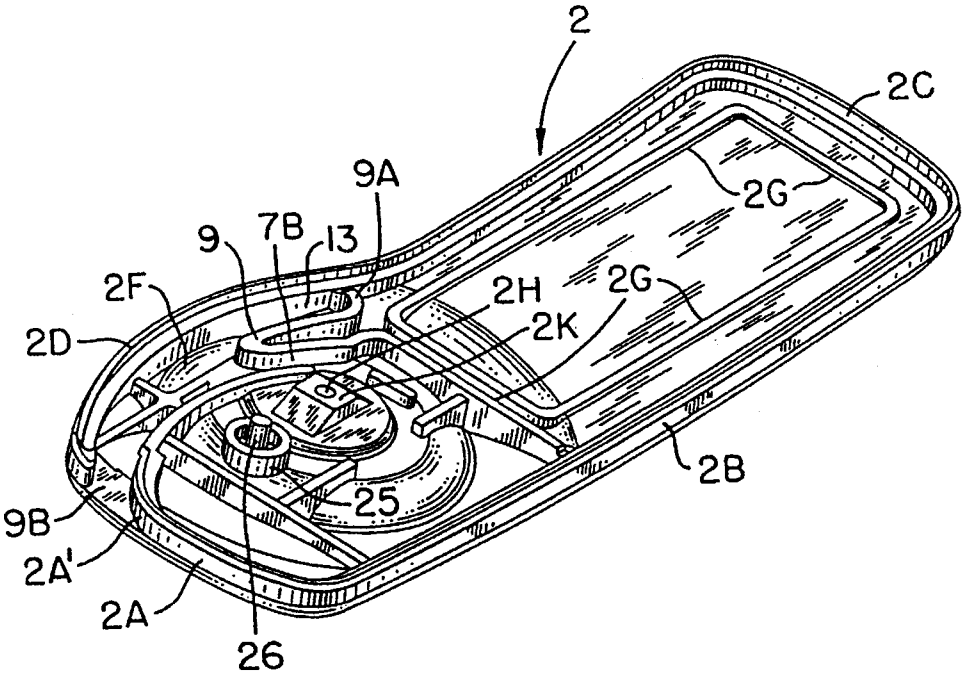
FIG. 4A shows a view of the interior of the upper housing of the EAS tag of FIG. 1.
Figure 5:
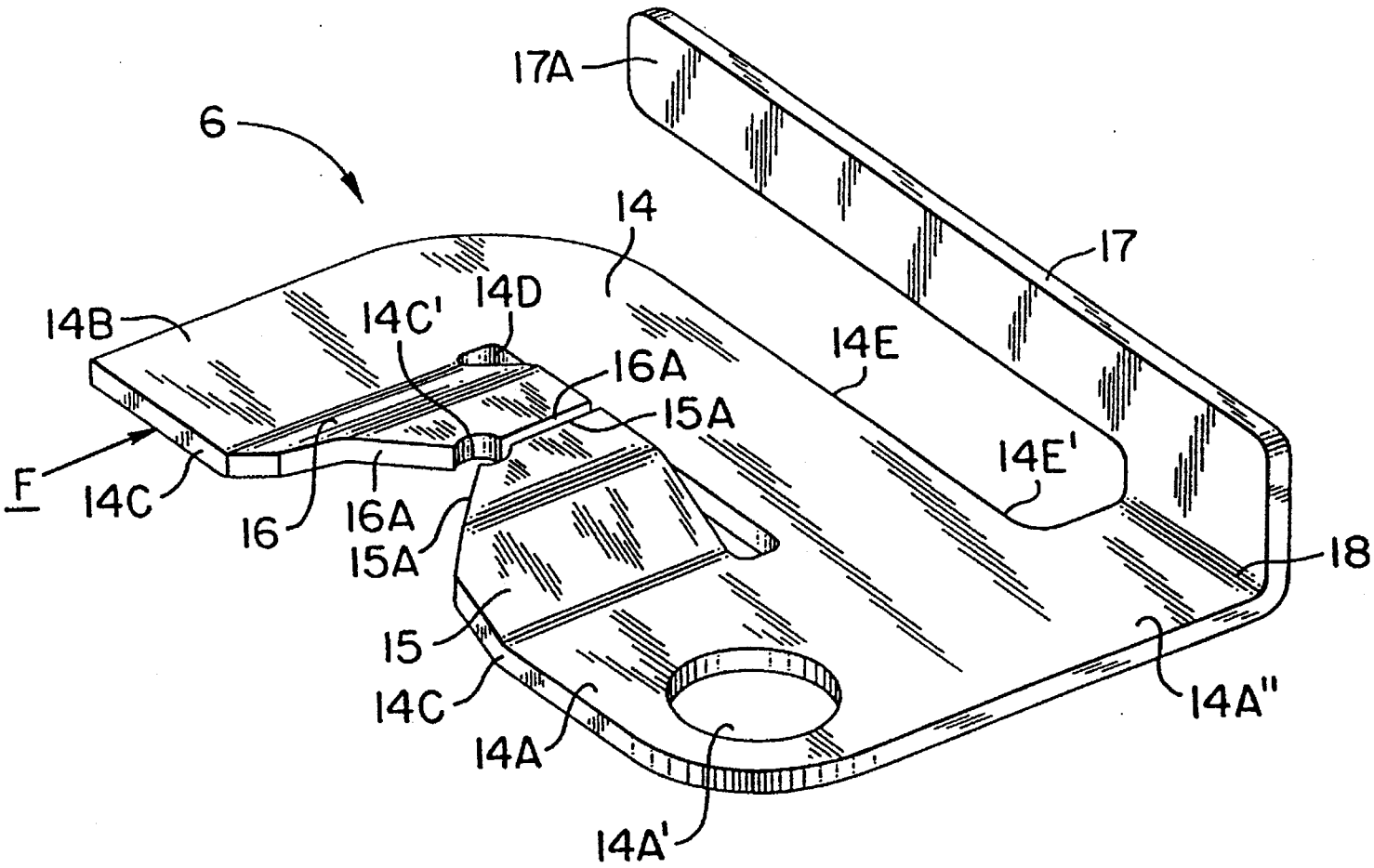
Figure 6A:
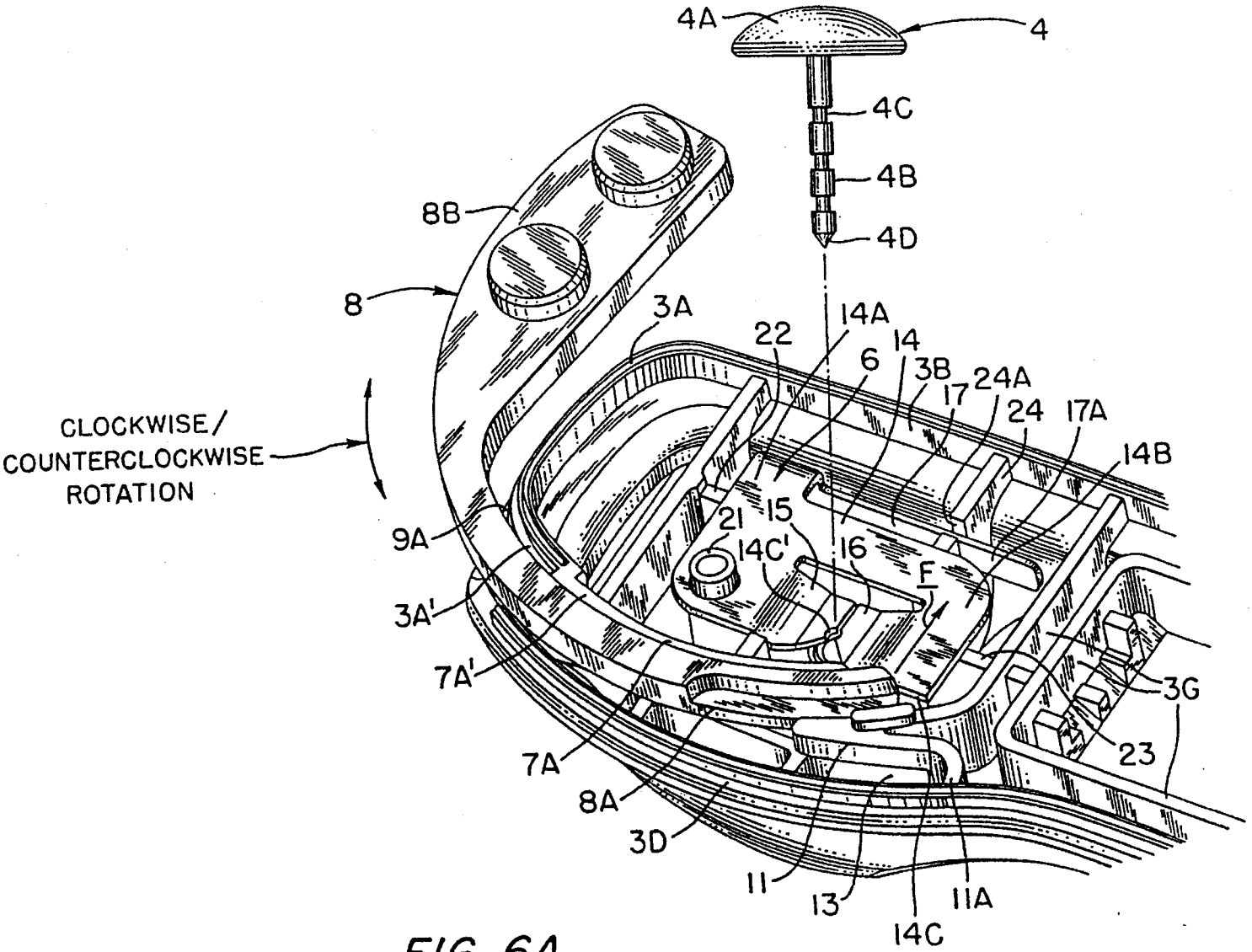
FIGS. 6A and 6B show partial views of the interior of the lower housing of the EAS tag of FIG. 1 with the probe inserted in and withdrawn from the arcuate channel of the tag, respectively.
Figure 6B:
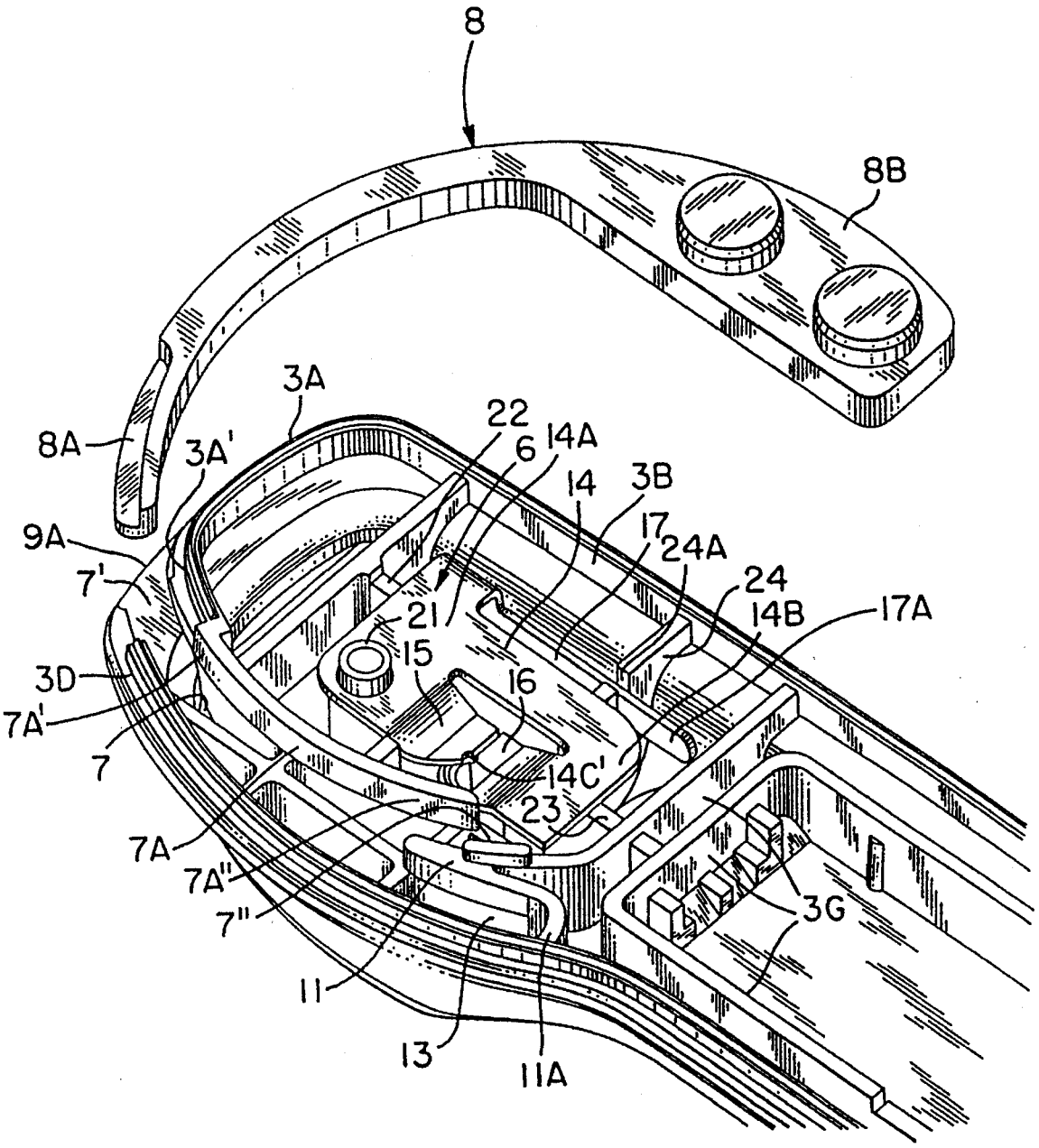
Figure 7:
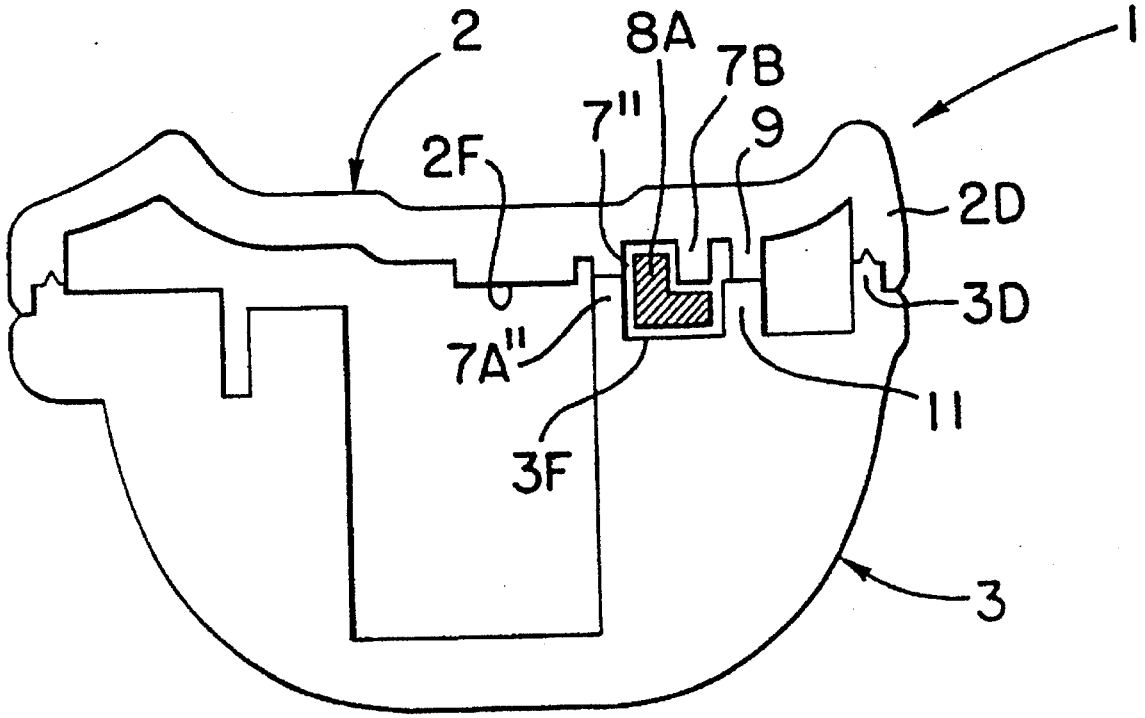
Figure 8:
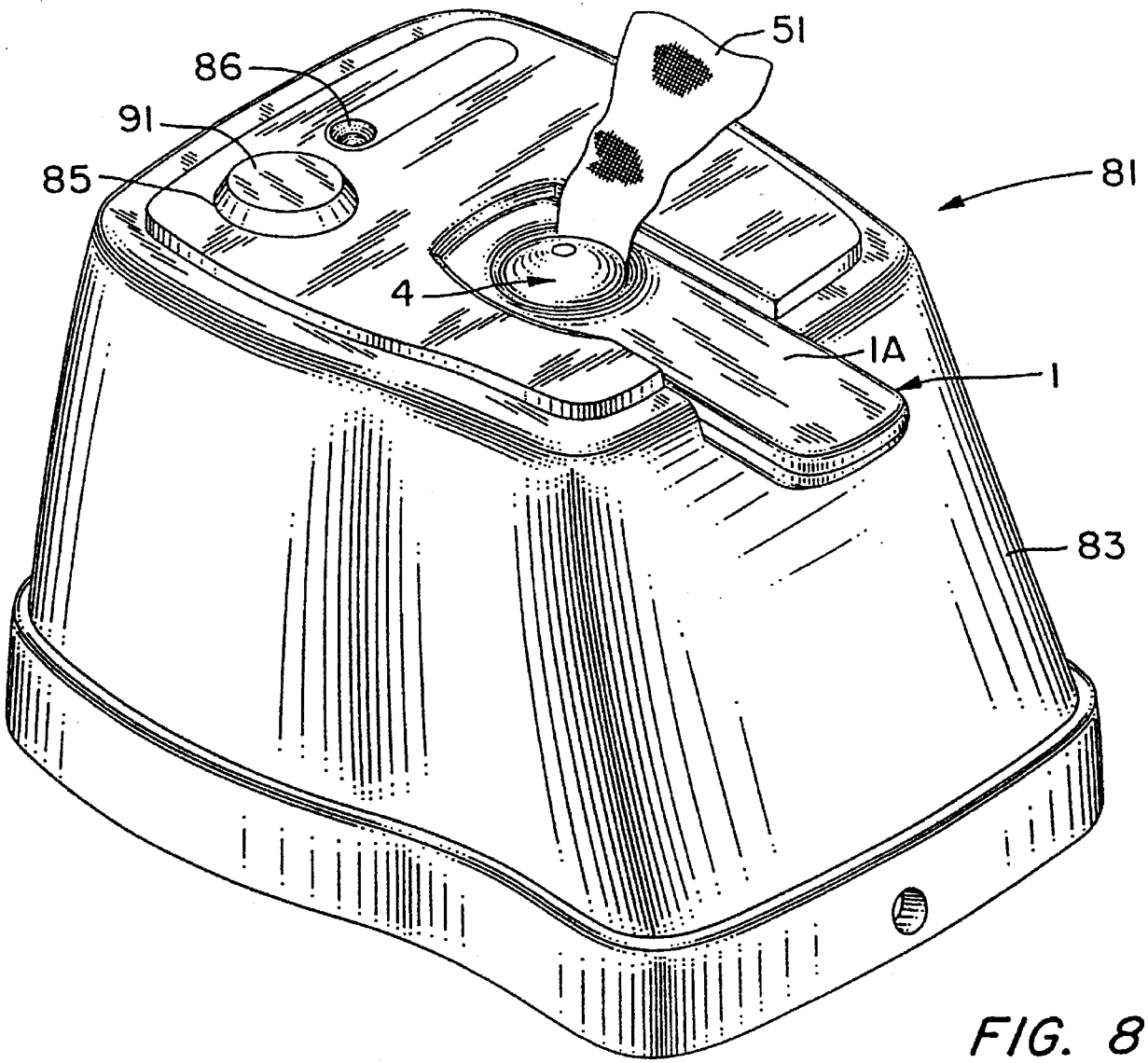
Figure 9:
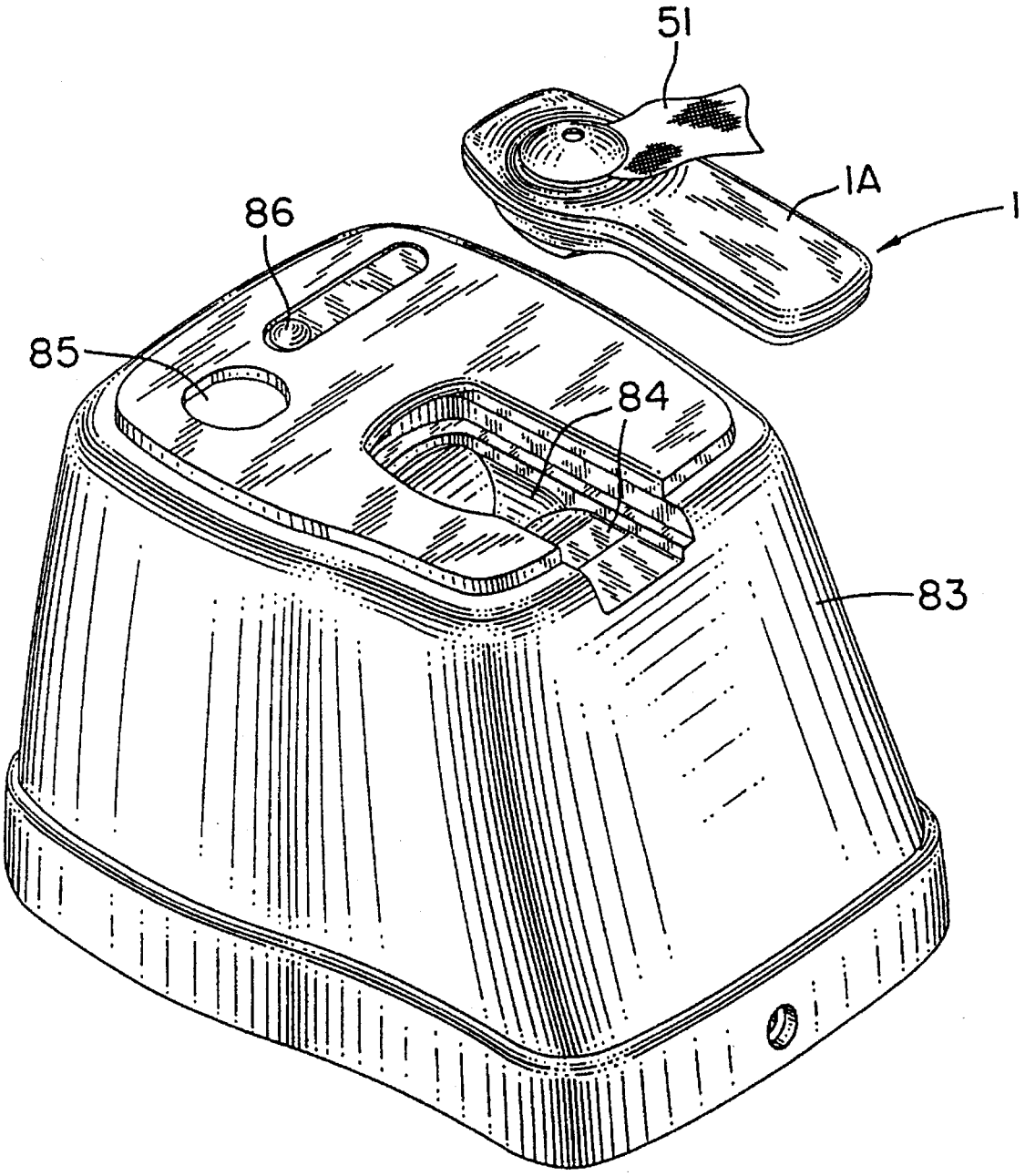
Figure 10:
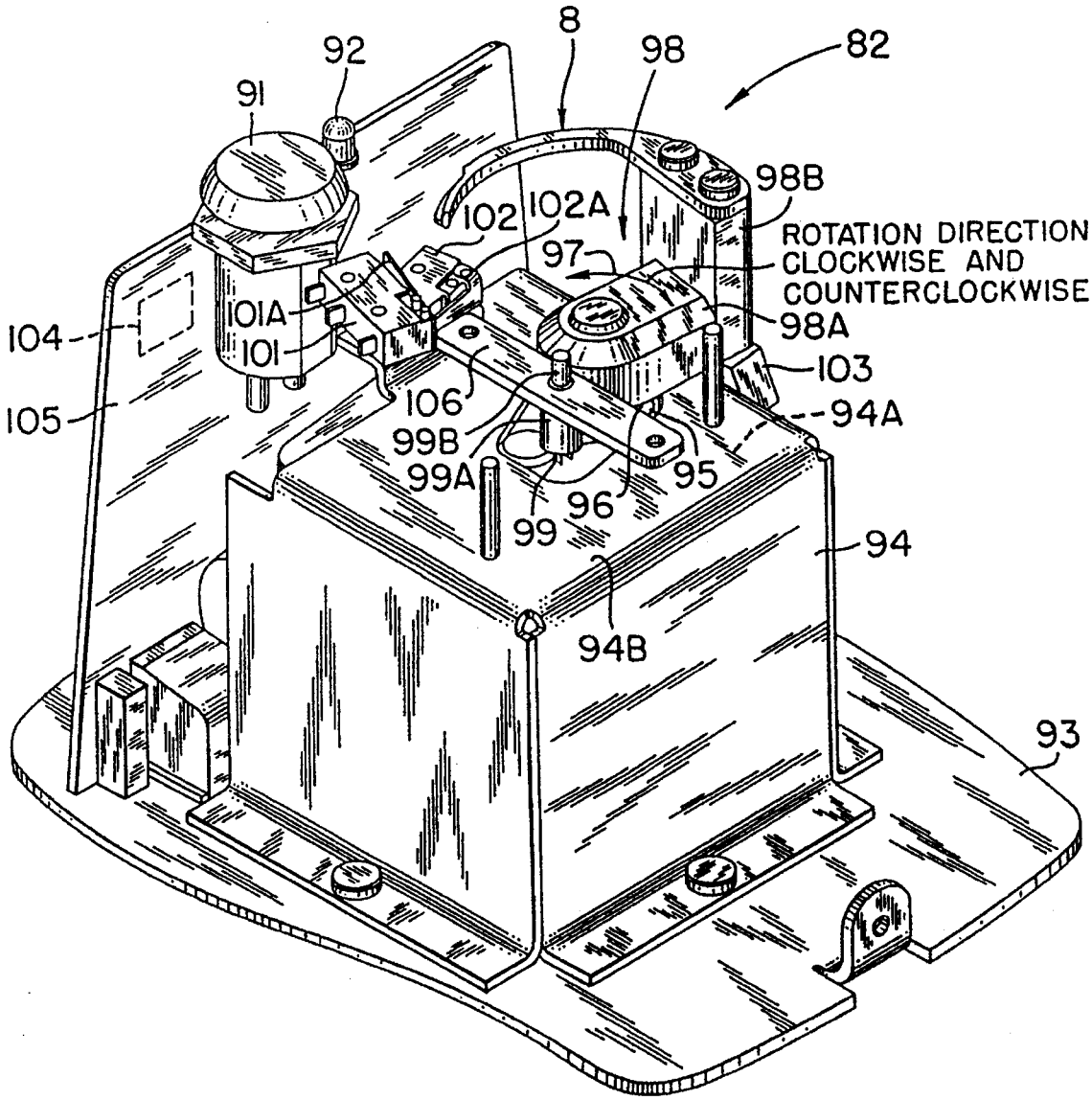
Figure 11:
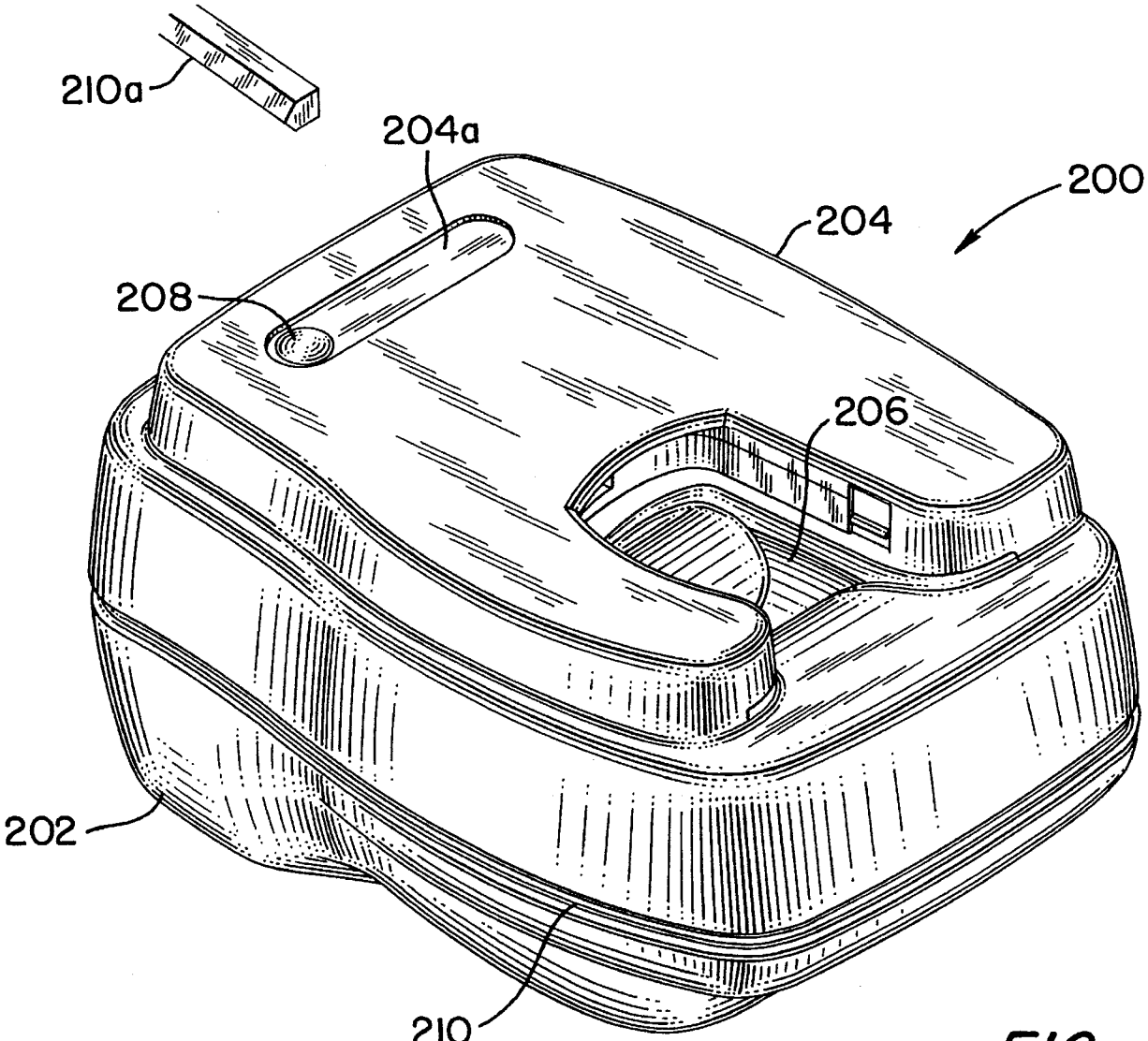
FIG. 11 shows a power actuated/tag activated detacher assembly in accordance with the present invention.

Referring to FIG. 11, power actuated/tag activated detacher assembly 200 includes separable upper cover 202 and base 202, the upper cover defining a nesting or cradle area 206 for receiving the tag body 1A of the tag 1.

ON/OFF switch 208 is accessible through opening 204*a* in upper cover 204. The upper cover and base are beveled at 210 to provide a groove for mounting of assembly 200 on a support member when the assembly is not hand held, a portion of the support member being indicated at 210*a*.

Figure 12:
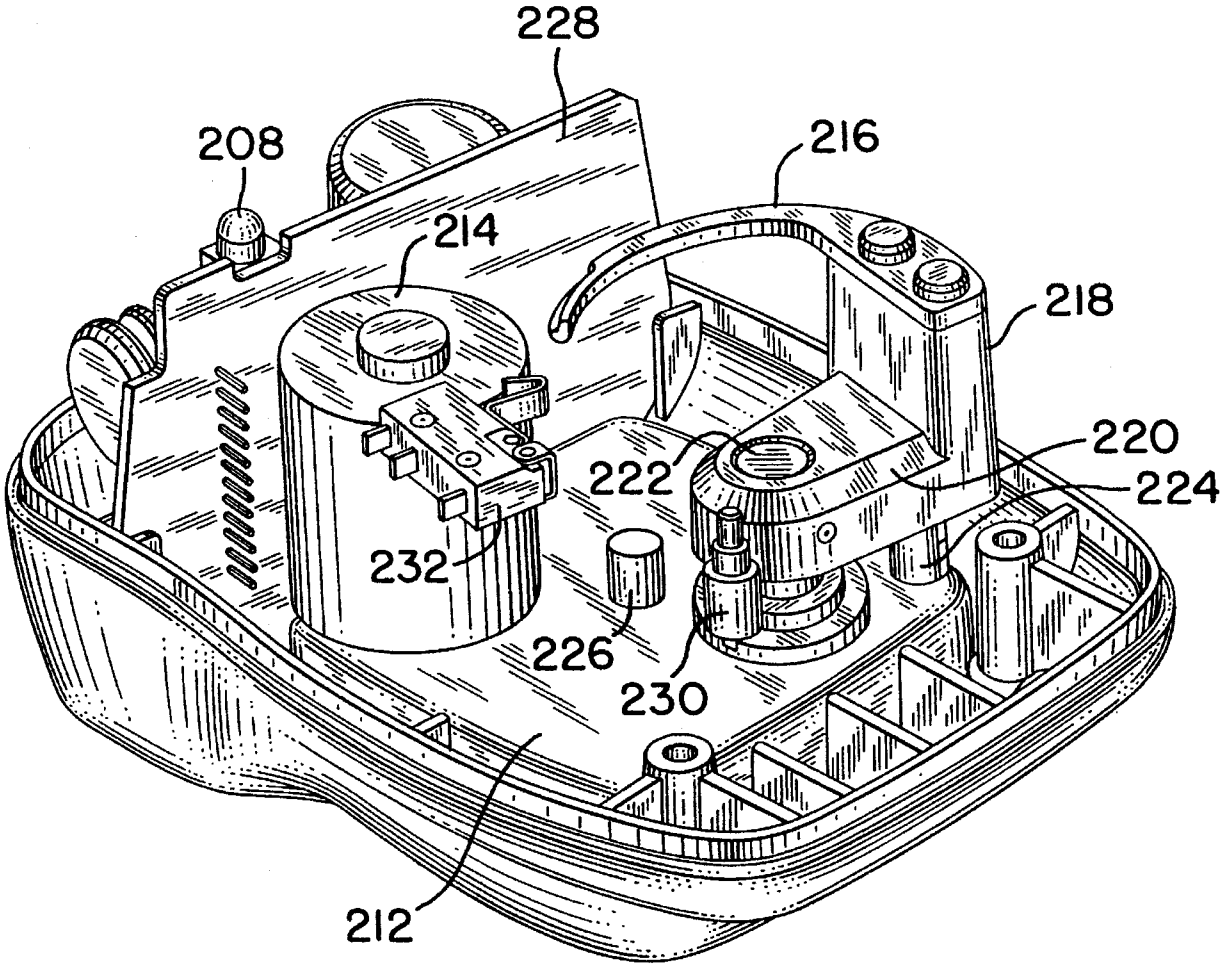
FIG. 12 shows the detaching mechanism of the detacher assembly of FIG. 11, with a part removed to show detail.

In FIG. 12, upper cover 204 is removed and the detaching mechanism of assembly 200 is shown with a component thereof removed to show detail. A gear box 212 is supported in base 202 and the gear box in turn supports motor 214 to which the gear box is clutched, motor 214 being of a variety inclusive of a clutch.

Probe or detaching hook 216 is supported by upstanding arm 218, which is integral with horizontal arm 220. Arm 220 is non-rotationally secured to shaft 222, which delivers the output motion of gear box 212. Mechanical stops 224 and 226 are secured fixedly to the upper surface of gear box 212, and serve as respective home and maximum travel stops for horizontal arm 220.

Printed circuit board 228 contains circuitry constituting the control system, below discussed in connection with FIG. 14. Switch assembly 230 is counterpart to the switch spring biased upstanding plunger 99B and switch 99 of the '592 patent application.

Figure 13:
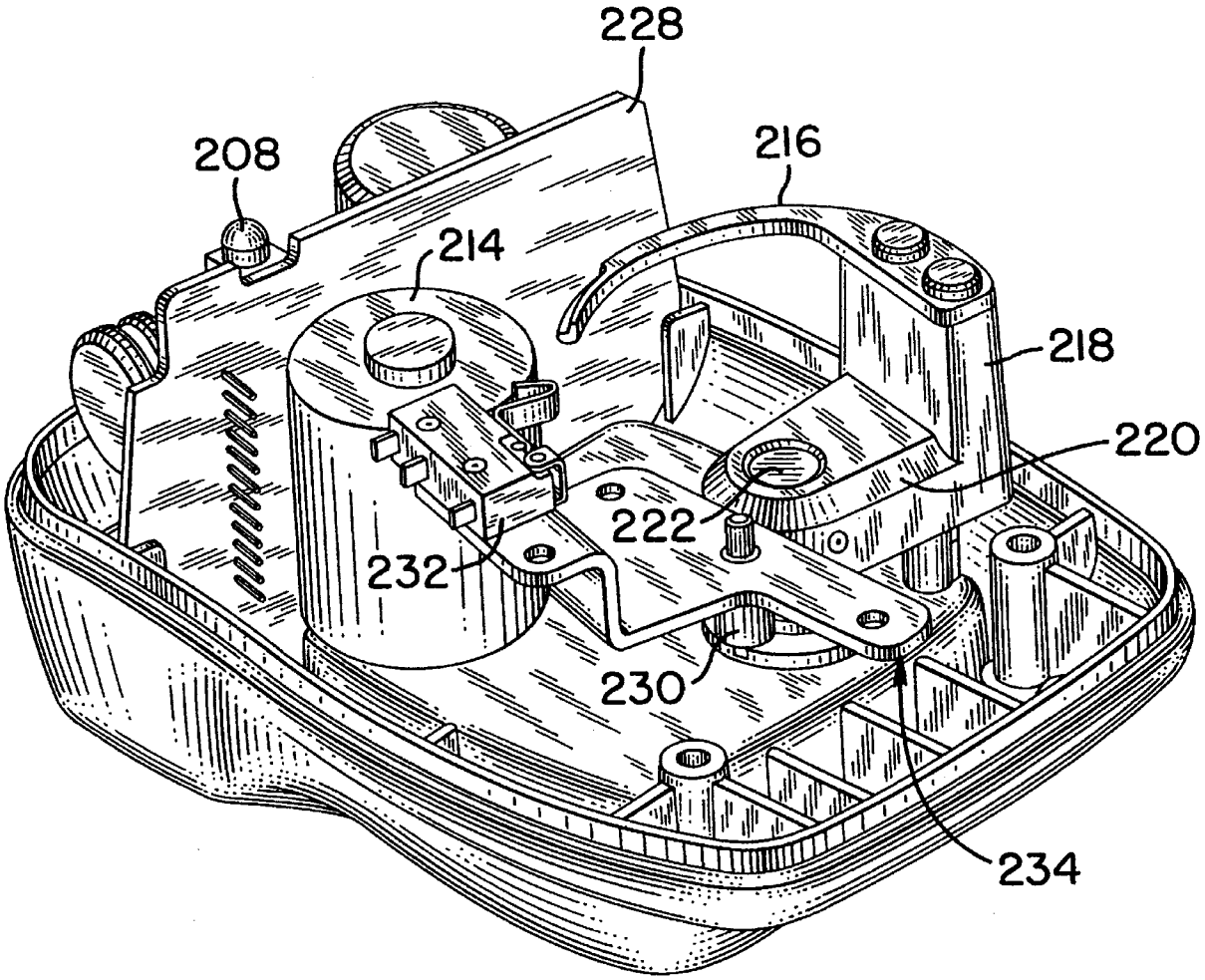
FIG. 13 repeats the showing of FIG. 12, but with the removed part in place.

Turning to FIG. 13, the omitted component of the FIG. 12 showing is included, i.e., bracket 234. It both supports switch 232 and seats about the plunger of switch assembly 230.

Figure 14:
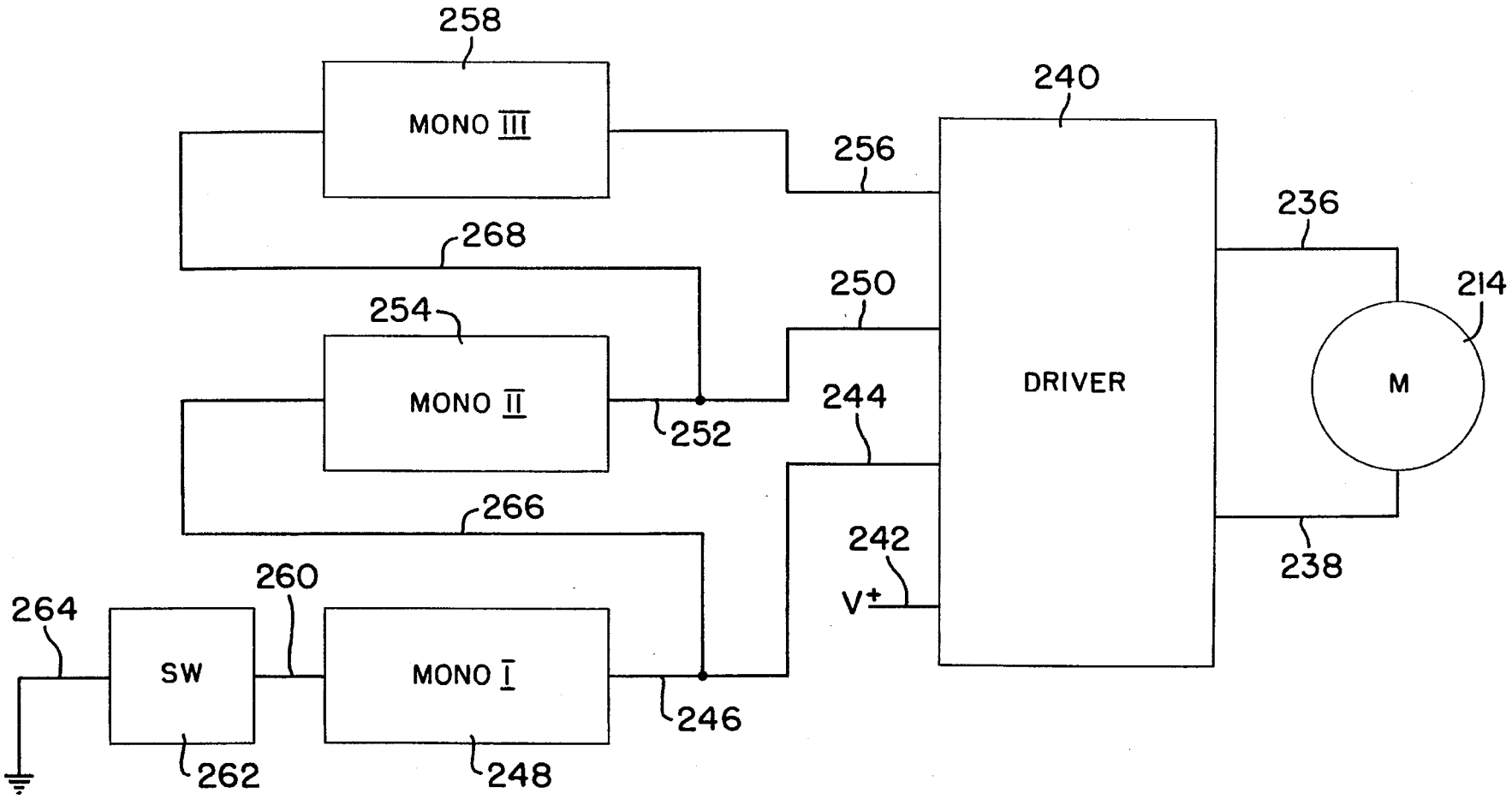
FIG. 14 is a functional block diagram of the probe movement control system of the invention.

Control system 236 is shown in functional block diagram in FIG. 14 and has output connection to motor (M) 214 over lines 236 and 238. Motor drive is provided by driver 240, which is preferably a Unitrode driver IC, UDN1295-4. Positive direct-current voltage is input to driver 240 over line 242.

A first control input to driver 240, furnished over lines 244 and 246, is the output signal of MONO I, a first one-shot multivibrator 248. A second control input to driver 240, furnished over lines 250 and 252, is the output signal of MONO II, a second one-shot multivibrator 254. A third control input to driver 240, furnished over line 256, is the output signal of MONO III, a third one-shot multivibrator 258.

The input to MONO I on line 260 is furnished through switch assembly SW 262, which is connected to electrical ground. SW 262, as discussed further below, comprises a series circuit of switches 230 and 232.

The input to MONO II is the output of MONO I, furnished on line 166. The input to MONO III is the output of MONO II, furnished on line 268.

In implementing the control system with the above-noted Unitrode driver IC, the BRAKE (bar) input terminal thereof is connected to line 256. The PHASE terminal thereof is connected to line 250. The OE (bar) terminal is connected to line 244. Motor drive lines 236 and 238 are connected respectively to output terminals OUT A and OUT B of the driver.

Applicants herein look to detacher mechanism control differently from the control of the '592 patent application, wherein four switches are involved as is a non-clutched motor. They thus observe three events at hand. There is first the rotation of the probe to its tag lock release position. There is then the removal of the tag from the article. Lastly, there is the return rotation of the probe to its home position.

Stop 224 defines the home position of the probe and stop 226 defines the tag lock release position of the probe. As in the case of the two activation switches of the '592 patent application, joint closure of switches 230 and 232 is taken as an indication that a tag is in proper position in the detacher assembly for opening its lock.

Broadly, applicants define a cumulative time period for the required rotations of the probe and the removal of the tag from the article. MONO I is selected correspondingly with such cumulative time period. MONO II is selected to correspond with the time required for the probe to reach its tag-unlocking disposition (a first sub-period) and to then ready the system for probe return to home movement. MONO III is selected to correspond with a time needed for separation of the tag from the article (a second sub-period) and to provide braking of the motor during such time. Motor rotation sense is caused to be of one sense during the operation of MONO II and is caused then to be of opposite sense during the remainder of the cumulative time period. Return movement of the probe occurs during a third sub-period of the cumulative time, i.e., it is equal to the cumulative time less the first and second sub-periods.

More particularly, referring again to FIG. 14, when line 260 is LO, i.e., SW 262 is conductive, the Q-bar output of MONO I goes LO and furnishes LO to line 246, whence LO is applied over line 244 to the OE-bar input terminal of driver 240, and to line 266, triggering MONO II. MONO II accordingly applies HI from its Q output terminal to line 250 and hence to the PHASE input terminal of driver 240. Driver 240 is responsive to these existing conditions on lines 244 and 250 to drive motor 214 in one sense, e.g., counterclockwise, during the ON state of MONO II.

When MONO II times out, its Q terminal goes LO, which triggers MONO III over line 268. The Q-bar terminal of MONO III then goes LO, and LO is fed over line 256 to the BRAKE-bar input terminal of driver 240. Driver 240 is responsive to such input signal to apply equal driving voltage to leads 236 and 238, accordingly placing no driving voltage on motor 214. This condition continues until MONO III times out, affording time for removal of the tag from the article.

When MONO III times out, its Q-bar output terminal goes HI, and driver 240 discontinues its supply of equal voltage to lines 236 and 238. The conditions on lines 244 and 250 are now controlling.

Since MONO II has timed out, its Q terminal is LO, calling for driver 240 to note line 250 and reverse motor drive sense, e.g., to clockwise. Since MONO I has not yet timed out, line 244 remains LO, and driver 240 furnishes driving voltage to motor 214. This return of the probe toward its home position continues until MONO I times out. As will be appreciated, stops 224 and 226 prevent overtravel of the probe at each of its home and remote positions.

By way of summary and introduction to the ensuing claims, in one aspect, the invention will be seen to provide apparatus for detaching an electronic surveillance tag from an article to which it is attached, the tag having a locking member therein and defining an exteriorly accessible passage to the locking member. The apparatus comprises a motor, a probe rotatable by the motor for movement in the passage into and from unlocking relation with the locking member and a drive controller for the motor. The drive controller includes circuitry for (1) establishing a time period for energization of the motor, (2) effecting first sense movement of the probe during a first portion of the time period, (3) discontinuing movement of the probe during a second portion of the time period, and (4) effecting second sense movement of the probe following expiration of the second portion during a third portion of the time period. The probe is supported for rotational movement. The first portion of the time period corresponds to a time for movement of the probe from a home position thereof to a position thereof for attaining the unlocking relation with the locking member. The second portion of the time period corresponds to a time for removal of the tag from the article. The third portion of the time period corresponds to a time for return of the probe from the position thereof for attaining the unlocking relation with the locking member to the home position.

The apparatus includes stop members located at the home position and at the position at which the probe attains the unlocking relation with the locking member, the stop members precluding movement of the probe therebeyond.

The motor includes a clutch, and the apparatus includes a gear box receiving input from the motor and imparting movement to the probe. The apparatus includes a base supporting the motor and the probe and a cover releasably secured to the base and enclosing the motor and the probe. The cover defines a nest for receipt of the tag. The motor driving circuitry includes activating circuitry, for initiating operation of the apparatus, disposed in registry with the cover nest. The activating circuitry includes a first switch disposed sidewardly adjacent the cover nest and a second switch disposed downwardly of the nest.

The circuit includes a first monostable circuit triggerable by the activating circuitry to define a time period, a second monostable circuit triggerable by the first monostable circuit to define a first portion of the time period and a third monostable circuit triggerable by the second monostable circuit to define a second portion of the time period. A driver circuit receives input signals from each of the first, second and third monostable circuits. The driver circuit is responsive to the input signals received from the first and second monostable circuit to effect movement of the motor in a first sense during the first portion of the time period, is responsive to the input signal received from the third monostable circuit to brake the motor during the second portion of the time period and is responsive to the input signals received from the first and second monostable circuits following discontinuance of braking of the motor to effect movement of the motor in a second sense during a third portion of the time period.

In another aspect, the invention provides apparatus comprising a motor, a probe rotatable by the motor for movement in the passage into and from a home position to an operative position for unlocking the locking member, a base supporting the motor and the probe and a cover secured to the base and enclosing the motor and the probe, the base and the cover jointly defining structure for releasably securing the apparatus to support structure for the apparatus. The base and the cover jointly define a groove at the exterior of the apparatus as the structure for releasably securing the apparatus to support structure for the apparatus.

In a further aspect, the invention provides apparatus comprising a motor, a probe rotatable by the motor for movement in the passage into and from a home position to an operative, tag-unlocking position, a base supporting the motor and the probe and stop members fixedly secured to the base at the home position and at the operative position for precluding movement of the probe therebeyond. The apparatus includes a support extending upwardly of the base and disposing the probe distal from the base, the stop members and the probe support being mutually engagable during movement of the probe.

Various changes in structure to the described systems and apparatus and modifications in the described practices may evidently be introduced without departing from the invention. Accordingly, it is to be understood that the particularly disclosed and depicted embodiments are intended in an illustrative and not in a limiting sense. The true spirit and scope of the invention are set forth in the following claims.

What is claimed is:

1. In combination:

an electronic surveillance tag and an apparatus for detaching an electronic surveillance tag from an article to which it is attached, said tag having a locking means therein and defining an exteriorly accessible passage to said locking means, said apparatus comprising:

(a) a motor;

(b) a probe rotatable by said motor for movement in said passage into and from unlocking relation with said locking means; and (c) drive means for said motor including circuit means for (1) establishing a time period for energization of said motor, (2) effecting first sense excitation of said motor and attendant first sense movement of said probe during a first portion of said time period, (3) discontinuing movement of said probe during a second portion of said time period; and (4) effecting second sense excitation of said motor and attendant second sense movement of said probe following expiration of said second portion during a third portion of said time period; and (d) a cover for said apparatus, said cover defining a nest for receipt of said tag; and said tag resident in said cover nest.

2. The invention claimed in claim 1, wherein said probe is supported for rotational movement.

3. The invention claimed in claim 1, wherein said first portion of said time period corresponds to a time for movement of said probe from a home position thereof to a position thereof for attaining said unlocking relation with said locking means.

4. The invention claimed in claim 3, wherein said second portion of said time period corresponds to a time for removal of said tag from said article.

5. The invention claimed in claim 4, wherein said third portion of said time period corresponds to a time for return of said probe from said position thereof for attaining said unlocking relation with said locking means to said home position.

6. The invention claimed in claim 5, further including stop means located at said home position and at said position at which said probe attains said unlocking relation with said locking means for, said stop means precluding movement of said probe therebeyond.

7. The invention claimed in claim 1, wherein said motor is of a variety including a clutch.

8. The invention claimed in claim 7, further including a gear box receiving input from said motor and imparting movement to said probe.

9. The invention claimed in claim 1, further including a base supporting said motor and said probe, said cover being releasably secured to said base and enclosing said motor and said probe.

10. The invention claimed in claim 1, wherein said circuit means includes activating means for initiating operation of said drive means, said activating means being disposed in registry with said cover nest.

11. The invention claimed in claim 10, wherein said activating means includes a first switch disposed sidewardly adjacent said cover nest and a second switch disposed downwardly of said nest.

12. The invention claimed in claim 10, wherein said circuit means includes a first monostable circuit triggerable by said activating means to define said time period.

13. The invention claimed in claim 12, wherein said circuit means includes a second monostable circuit triggerable by said first monostable circuit to define said first portion of said time period.

14. The invention claimed in claim 12, wherein said circuit means includes a third monostable circuit triggerable by said second monostable circuit to define said second portion of said time period.

15. The invention claimed in claim 14, wherein said circuit means includes a driver circuit receiving input signals from each of said first, second and third monostable circuits.

16. The invention claimed in claim 15, wherein said driver circuit is responsive to the input signals received from said first and second monostable circuit to effect movement of said motor in a first sense during said first portion of said time period.

17. The invention claimed in claim 16, wherein said driver circuit is responsive to the input signal received from said third monostable circuit to brake said motor during said second portion of said time period.

18. The invention claimed in claim 17, wherein said driver circuit is responsive to the input signals received from said first and second monostable circuits following discontinuance of braking of said motor to effect movement of said motor in a second sense during said third portion of said time period.

19. The invention claimed in claim 1, wherein said cover and said base define means adapted for releasable securement of said apparatus to support structure for said apparatus.

20. In combination:

an electronic surveillance tag and an apparatus for detaching an electronic surveillance tag from an article to which it is attached, said tag having a locking means therein and defining an exteriorly accessible passage to said locking means, said apparatus comprising:

(a) a motor;

(b) a probe rotatable by said motor for movement in said passage into and from a home position to an operative position for unlocking said locking means;

(c) a base supporting said motor and said probe; and (d) a cover secured to said base and enclosing said motor and said probe, said cover defining a nest for receipt of said tag, said base and said cover jointly defining means for releasably securing said apparatus to support structure for said apparatus; and said tag resident in said cover nest.

21. The invention claimed in claim 20, wherein said base and said cover jointly define a groove at the exterior of said apparatus as said means for releasably securing said apparatus to support structure for said apparatus.

22. In combination:

an electronic surveillance tag and an apparatus for detaching an electronic surveillance tag from an article to which it is attached, said tag having a locking means therein and defining an exteriorly accessible passage to said locking means, said apparatus comprising:

(a) a motor;

(b) a probe rotatable by said motor for movement in said passage from a home position to an operative position for unlocking said locking means and for movement from said operative position to said home position;

(c) a base supporting said motor and said probe;

(d) stop means fixedly secured to said base at said home position and at said operative position for precluding movement of said probe therebeyond;

(e) drive means for said motor including circuit means for effecting first sense excitation of said motor and said movement of said probe from said home position to said operative position and for effecting second sense excitation of said motor and said movement of said probe from said operative position to said home position; and (f) a cover for said apparatus, said cover defining a nest for receipt of said tag; and said tag resident in said cover nest.

23. The invention claimed in claim 22, further including support means extending upwardly of said base and disposing said probe distal from said base, said stop means and said probe support means being mutually engagable during movement of said probe.

* * * * *